United States Patent [19]

Yamamoto et al.

[11] Patent Number: 4,980,242

[45] Date of Patent: Dec. 25, 1990

[54] FIBER-REINFORCED METAL COMPOSITE

[75] Inventors: Tadashi Yamamoto; Michiyuki Suzuki; Yoshiharu Waku; Masahiro Tokuse, all of Yamaguchi, Japan

[73] Assignee: Ube Industries, Ltd., Japan

[21] Appl. No.: 331,211

[22] Filed: Mar. 31, 1989

[30] Foreign Application Priority Data

Apr. 1, 1988 [JP] Japan ..... 63-78064

[51] Int. Cl.[5] ..... C22C 32/00

[52] U.S. Cl. ..... 428/614

[58] Field of Search ..... 428/614

[56] References Cited

U.S. PATENT DOCUMENTS

| | | | |
|---|---|---|---|
| 4,342,712 | 8/1982 | Yajima et al. | 423/345 |
| 4,399,232 | 8/1983 | Yajima et al. | 501/38 |
| 4,753,850 | 6/1988 | Ibe et al. | 428/608 |

FOREIGN PATENT DOCUMENTS

| | | | |
|---|---|---|---|
| 0032355 | 7/1981 | European Pat. Off. . | |
| 57-169034 | 10/1982 | Japan . | |
| 58-5286 | 11/1983 | Japan . | |
| 60-1405 | 7/1985 | Japan . | |
| 62-44547 | 2/1987 | Japan | 428/614 |
| 62-124245 | 6/1987 | Japan | 428/614 |
| 2179369 | 3/1987 | United Kingdom . | |

OTHER PUBLICATIONS

Patent Abstracts of Japan, vol. 12, No. 191 (C-501) [3038] Jun. 3, 1988.

Patent Abstracts of Japan, vol. 9, No. 306, (C-317) [2029] Dec. 3, 1985.

*Primary Examiner*—John P. Sheehan

*Assistant Examiner*—David Schumaker

*Attorney, Agent, or Firm*—Finnegan, Henderson, Farabow, Garrett & Dunner

[57] ABSTRACT

A fiber-reinforced metal composite (aluminum-matrix composite) consisting essentially of reinforcing fibers and an aluminum alloy containing 6 to 11 wt. % of nickel of a metal matrix.

10 Claims, 4 Drawing Sheets

FIBER-REINFORCED METAL COMPOSITE

BACKGROUND OF THE INVENTION

1. Field of the Invention

The present invention relates to a fiber-reinforced metal composite (FRM) comprising reinforcing fibers and an aluminum alloy as a matrix.

2. Description of the Related Art

Recently, due to the superior strength and rigidity thereof, fiber-reinforced metal composites have been used for various machine parts and structural materials. Among these composites, a fiber-reinforced composite material of aluminum or an alloy thereof reinforced with inorganic fibers or metal fibers is light and has a high rigidity and high heat resistance. Heretofore, such fiber-reinforced metal composites have been produced by methods such as infiltration, diffusion-bonding, and pressure casting.

In general, reinforcing fibers are used at a volume percentage of from 50 to 60% in the fiber-reinforced metal composite, and thus inevitably the fibers come into contact with each other, and this contact between the fibers prevents the obtaining of the expected strength of the fiber-reinforced metal composite from being obtained. Further, sometimes the compatibility between the reinforcing fibers and the metal matrix is poor and a reaction occurs at the interface, which causes the deterioration of the reinforcing fibers. Further, in the case of a matrix of aluminum or an alloy thereof, in particular, undesirable brittle crystals are generated.

It is considered that pure aluminum is most suitable as the matrix metal, since deterioration of the fibers and generation of brittle crystals does not occur when pure aluminum is used. Nevertheless, since pure aluminum has low strength, when continuous reinforcing fibers are used, the fiber-reinforced aluminum composite has a poor strength in the transverse direction at a right angle to the continuous fiber orientation, and if a component part is formed only partially of fiber-reinforced aluminum, and the remainder thereof does not contain the reinforcing fibers but is formed of aluminum alone, such a remaining part has low strength.

To solve the above-mentioned problems, composite materials (fiber-reinforced metal composites) having an aluminum alloy matrix have been proposed. For example, an aluminum alloy containing 0.5 to 6.0 wt% of nickel (Ni) is disclosed in Japanese Unexamined Patent Publication (Kokai) No. 62-124245, and another aluminum alloy containing at least one element selected from the group consisting of Bi, Sb, Sn, In, Cd, Sr, Ba and Ra is disclosed in Japanese Unexamined Patent Publication (Kokai) No. 57-169034. Nevertheless, these proposed fiber-reinforced metal composites do not have the required strength or corrosion resistance.

SUMMARY OF THE INVENTION

An object of the present invention is to provide a fiber-reinforced metal (aluminum) composite having an increased strength.

Another object of the present invention is to provide an aluminum-matrix composite reinforced with Si—Ti—C—O inorganic fibers.

These and other objects of the present invention are obtained by providing a fiber-reinforced metal composite consisting essentially of reinforcing fibers and an aluminum alloy containing 6 to 11 wt% of nickel.

Preferably, the reinforcing fibers are continuous inorganic fibers such as Si—T—C—O fibers, SiC fibers, $Si_3N_4$ fibers, alumina ($Al_2O_3$) fibers, $Al_2O_3$—$SiO_2$ fibers, boron fibers, $B_4C$ fibers, and carbon fibers, or continuous metal fibers such as stainless steel, piano wire fibers, tungsten fibers, titanium fibers, molybdenum fibers and nickel fibers. The Si—T—C—O fibers are disclosed in Japanese Examined Patent Publication (Kokoku) Nos. 58-5286 and 60-1405 and U.S. Patent Nos. 4342712 and 4399232, and are commercially produced by Ube Industries, Ltd. Instead of the continuous fibers, it is possible to use short (staple) fibers such as alumina short fibers, $Al_2O_3$—$SiO_2$ short fibers, zirconia short fibers as produced, and chopped fibers prepared by cutting the continuous fibers. It is also possible to use whiskers such as SiC whiskers, $Si_3N_4$ whiskers, carbon whiskers and $Al_2O_3$ whiskers, $K_2O{\cdot}6TiO_2$ whiskers, $K_2Ti_2O_5$ whiskers, $B_4C$ whiskers, $Fe_3C$ whiskers, chromium whiskers, copper whiskers, iron whiskers and nickel whiskers.

According to the present invention, the aluminum alloy matrix contains 6 to 11 wt%, preferably 7 to 10 wt%, of nickel, whereby fine fibrous crystals having diameters of 0.2 μm or less are uniformly generated in quantity at the interface between the reinforcing fibers and the matrix, and as a result, contact between the fibers is reduced to a minimum and the compatibility between the fibers and the matrix is remarkably improved. Therefore, the strength of the fiber-reinforced metal composite according to the present invention is superior to that of conventional fiber-reinforced aluminum composites.

BRIEF DESCRIPTION OF THE DRAWINGS

The present invention will be more apparent from the description of the preferred embodiments set forth below, with reference to the accompanying drawings, in which.

DESCRIPTION OF THE PREFERRED EMBODIMENTS

Example 1

Fiber-reinforced metal (aluminum) composites were produced in the following manner.

Many Si—T—C—O continuous fibers were unidirectionally arranged to form a fiber preform held by a frame. The fiber preform was preheated at 700° C. for 30 minutes in a furnace under an ambient atmosphere, and a metal mold and a plunger of a pressure casting apparatus were heated at 300° C. by a heating means. A pure aluminum melt and binary aluminum alloy melts containing nickel (Ni) in amounts of 1 to 10 wt%, in increments of 1 wt%, were prepared, respectively.

Figure 1:
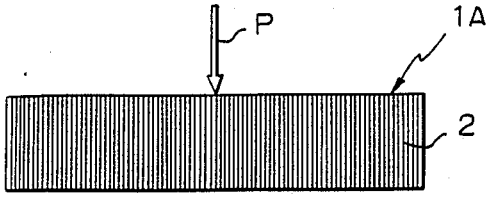
FIG. 1 is a sectional view of a fiber-reinforced metal composite test piece which is bent by a load applied in parallel to the fiber orientation.
Figure 2:
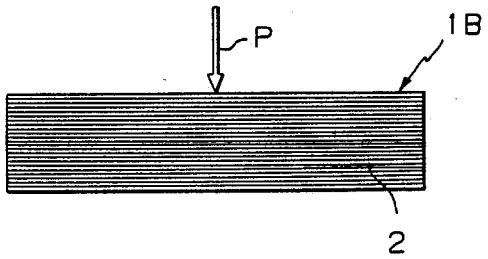
FIG. 2 is a sectional view of a fiber-reinforced metal composite test piece which is bent by a load applied at a right angle to the fiber orientation.

The fiber preform was placed in a cavity of the metal mold and the prepared melt was poured into the cavity to cover the fiber preform. Subsequently, the plunger was inserted into the cavity of the metal mold and a pressure of 1000 kg/cm$^2$ was applied to the melt, and then the mold and plunger were cooled to allow the melt to solidify under the pressure. The thus obtained fiber-reinforced metal composite was taken out the cavity and machined to form test pieces 1A and 1B, as shown in FIGS. 1 and 2, for the bending tests. The test pieces of the fiber-reinforced metal composite had a fiber content of 50 vol%.

In one 1A of the test pieces 1A, the fibers 2 were oriented at a right angle to the longitudinal axis of the test piece, as shown in FIG. 1, and in the other test piece 1B, the fibers 2 were oriented in parallel to the longitudinal axis of the test piece, as shown in FIG. 2. The test pieces 1A and 1B contained a metal matrix of pure aluminum and binary aluminum alloys containing different nickel contents, respectively.

The test pieces 1A and 1B were tested by applying a bending load P thereto, as shown in FIG. 1 or 2, to measure the flexural strength of each test piece 1A and 1B. In FIG. 1, the load P was applied in parallel to the fiber orientation, and in FIG. 2, the load P was applied at a right angle to the fiber orientation.

Figure 3:
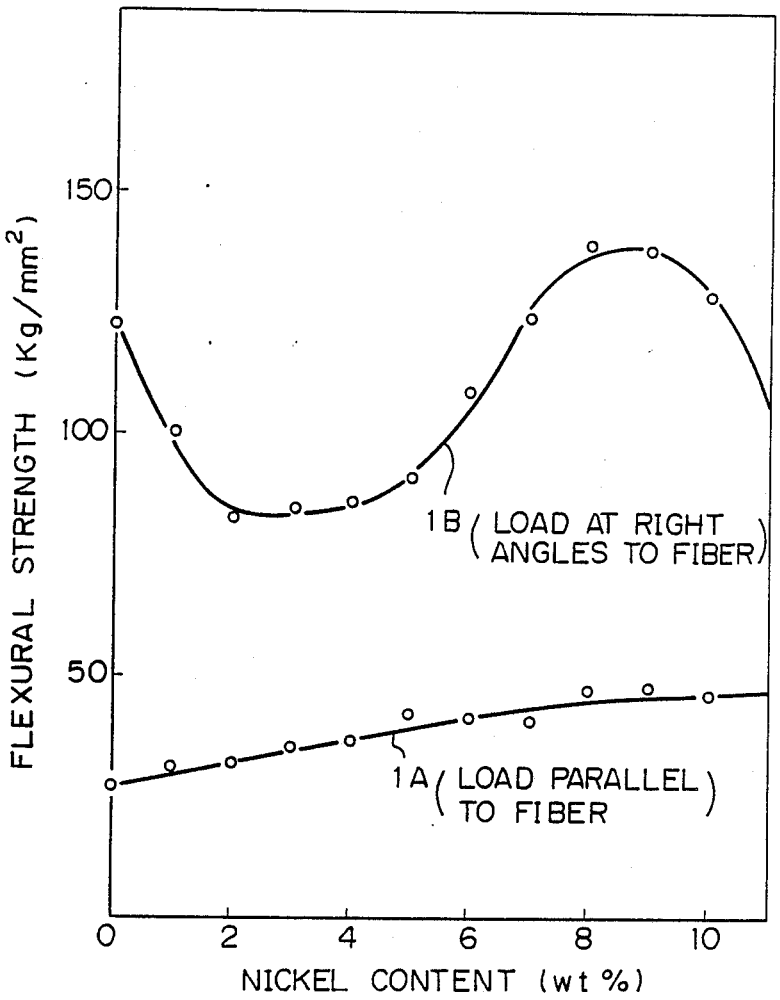
FIG. 3 is a graph showing relationships between the nickel content and flexural strengths of fiber-reinforced metal composites.

The results of the bending test (the obtained flexural strength values) are shown in FIG. 3, wherein the abscissa represents the nickel content and the ordinate represents the flexural strength.

As can be seen from FIG. 3, the flexural strength of the test piece 1B to which the load P was applied at a right angle to the fiber orientation varies downward, then upward to a peak value, and then downward again, as the nickel content is increased. The maximum flexural strength value was obtained at the nickel content of the metal matrix of 8 wt%. Where the nickel content is from 6 to 11 wt%, the flexural strength of the fiber-reinforced aluminum alloy composite is greater than the flexural strength of the fiber-reinforced pure aluminum composite.

Figure 4:
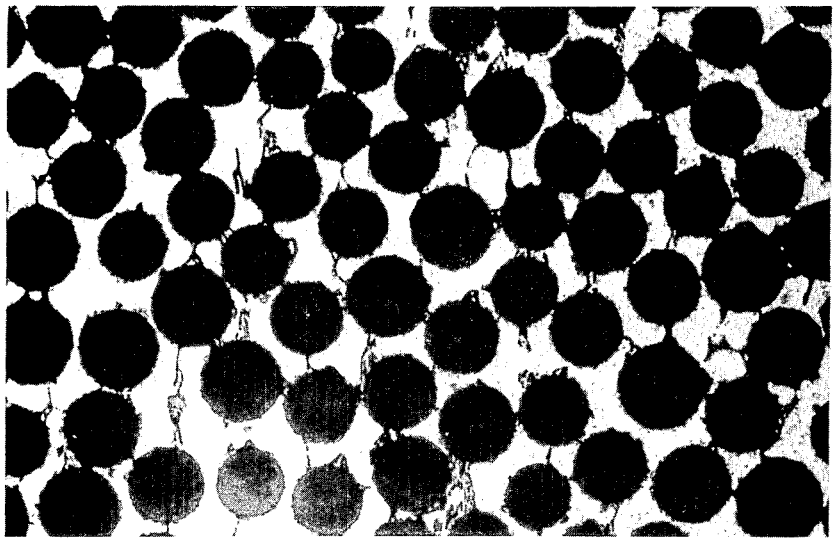
FIG. 4 is a photomicrograph (×1000) of a fiber-reinforced metal composite having a metal matrix of Al-2%Ni, in a transverse direction to the fiber orientation.
Figure 5:
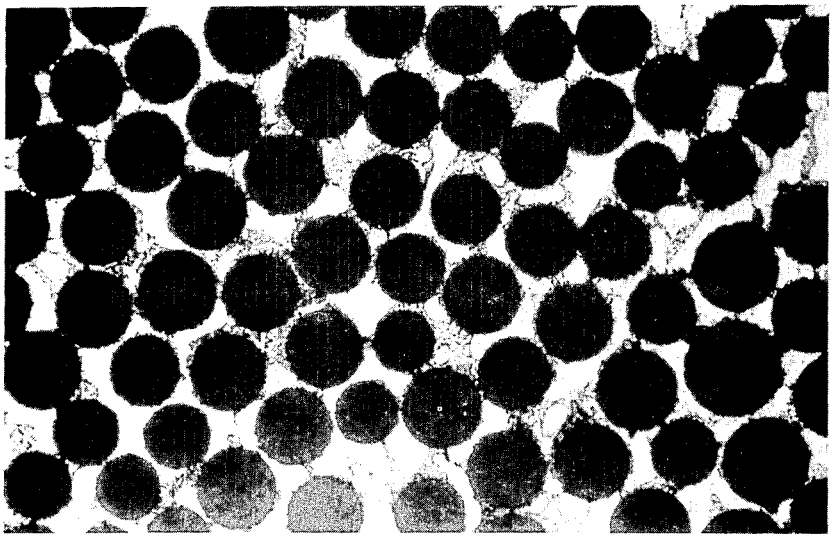
FIG. 5 is a photomicrograph (×1000) of a fiber-reinforced metal composite having a metal matrix of Al-4%Ni.
Figure 6:
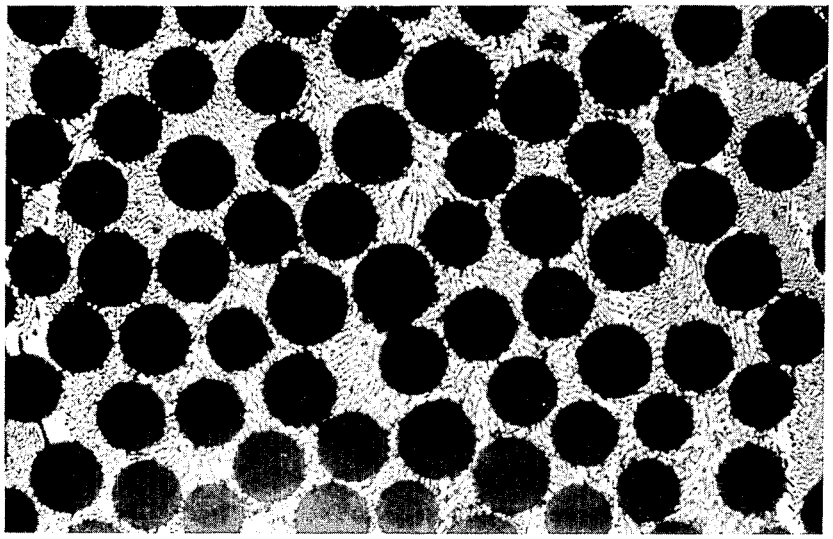
FIG. 6 is a photomicrograph (×1000) of a fiber-reinforced metal composite having a metal matrix of Al-8%Ni according to the present invention.

The test pieces of the fiber-reinforced metal composites were examined by using an optical microscope, an Auger electron spectroscope (AES), a scanning electron microscope (SEM), an electron probe microanalyzer (EPMA), and a transmission electron microscope (TEM) or the like. FIGS. 4, 5 and 6 are photomicrographs (×1000) of the test pieces having a metal matrix containing 2 wt%, 4 wt%, and 8 wt% of nickel, respectively, in the transverse direction to the fiber orientation. As shown in FIGS. 4 and 5, fine needle-like crystals of eutectic $Al_3Ni$ are nonuniformly generated at the interface between the reinforcing (Si—T—C—O) fibers and the alloy matrix, and such crystals cause stress concentration under a load. Therefore, the flexural strengths of the test pieces having a metal matrix containing 1 to 6 wt% of nickel are lower than that of the test piece having a pure aluminum matrix. Where the test piece had an Al-2%Ni matrix (FIG. 4), in particular, since relatively large needle-like crystals are nonuniformly generated, the flexural strength thereof is the minimum value obtained. As the nickel content is increased, the crystals are made finer and are uniformly generated in the matrix in a large quantity, as shown in FIG. 6 of the test piece having an Al-8%Ni matrix according to the present invention. The pressure of so many finer crystals does not cause stress concentration but produces a strengthening effect due to the particle dispersion. Nevertheless, a matrix containing more than 11 wt% of nickel has a lower flexural strength, since coarse primary crystals ($Al_3Ni$) are formed, which causes stress concentration under a load.

On the other hand, as shown in FIG. 3, the flexural strength of the test pieces 1A to which the load P was applied in parallel to the fiber orientation is increased monotonously with an increase of the nickel content. In this case, the strengthening effect of the reinforcing fibers for the test pieces 1A is very low, compared with that of the test pieces 1B. Namely, the strength of the metal matrix has an influence on the flexural strength of the test piece (i.e., fiber-reinforced metal composite). That is, the tensile strength of the matrix increases, as shown in Table 1, with an increase of the nickel content, whereby the flexural strength is gradually increased.

TABLE I

| Matrix Composition | Tensile Strength of Matrix only |
|---|---|
| pure Al | 6 kg/mm$^2$ |
| Al-3 wt % Ni | 13 kg/mm$^2$ |
| Al-8 wt % Ni | 20 kg/mm$^2$ |

EXAMPLE 2

Many carbon continuous fibers were uni-directionally arranged to form a fiber preform held by a frame. The fiber preform was preheated at 700° C. for 20 minutes in a furnace under an argon atmosphere, and a metal mold and a plunger of a pressure casting apparatus used in Example 1 were also preheated at 300° C. by a heating means. A pure aluminum melt and an Al-8wt%Ni melt were prepared, respectively, and heated at 720° C.

The carbon fiber preform was placed in a cavity of the mold and the melt of pure aluminum (or Al-8 wt%Ni) was poured into the cavity. Subsequently the plunger was fitted into the cavity and a pressure of 1000 kg/cm$^2$ was applied to the melt, and then the mold and the plunger were cooled to allow the melt to solidify under pressure. Each of the thus obtained fiber-reinforced metal composites was taken out the cavity and then machined to form test pieces 1A and 1B, as shown in FIGS. 1 and 2, for a bending test. The test pieces of the fiber-reinforced metal composites had a fiber content of 50 vol%. In one of the test pieces 1A, the (carbon) fibers 2 were oriented at a right angle to the longitudinal axis thereof, as shown in FIG. 1, and a bending load P was applied to the test piece 1A in parallel to the fiber orientation. In the other test piece 1B, the (carbon) fibers 2 were oriented in parallel to the longitudinal axis thereof, as shown in FIG. 2, and the bending load P was applied to the test piece 1B at a right angle to the fiber orientation. The results (the obtained flexural strengths) of the bend test are shown in Table 2.

TABLE 2

| Matrix Composition | Flexural Strength ($kg/mm^2$) Test Piece 1B Load at Right Angle to Fiber Orientation | Test Piece 1A Load Parallel to Fiber Orientation |
|---|---|---|
| Pure Al | 120 | 5 |
| Al-8 wt % Ni | 135 | 15 |

As can be seen from Table 2, the fiber-reinforced metal composite having an Al-8 wt%Ni matrix according to the present invention has a greater flexural strength than that of the fiber-reinforced metal composite having a pure aluminum matrix.

Suitable elements such as Si, Mn, Mg, Cn, Zn and the like can be added, to improve the strength of the binary-(Al-Ni) alloy of the metal matrix of the fiber-reinforced metal composite according to the present invention. Furthermore, instead of the Si—T—C—O fibers and carbon fibers used in Examples 1 and 2, other continuous inorganic fibers, such as SiC fibers, $Al_2O_3$ fibers, $Si_3N_4$ fibers, $Al_2O_2$-$SiO_2$ fibers, $B_4C$ fibers, and B fibers, or continuous metal fibers, such as stainless fibers, piano wire fibers, W fibers, Mo fibers, Be fibers, Ti fibers, and Ni fibers can be used. It is also possible to use short fibers such as $Al_2O_3$ short fibers, $Al_2O_3$—$SiO_2$ short fibers, $ZrO_2$ short fibers as produced, and chopped fibers prepared by cutting the continuous fibers. Further, in addition to the above-mentioned fibers, whiskers, such as SiC whiskers, $Si_3N_4$ whiskers, carbon whiskers, $Al_2O_3$ whiskers, $K_2O{\cdot}6TiO_2$ whiskers, $K_2Ti_2O_5$ whiskers, $B_4C$ whiskers, $Fe_3C$ whiskers, Cr whiskers, Cu whiskers, Fe whiskers and Ni whiskers can be used as the reinforcing fibers. The aluminum alloy containing 6 to 11 wt% of nickel is used as the metal matrix to improve the compatibility between the reinforcing fibers and the matrix.

It will be obvious that the present invention is not restricted to the above-mentioned embodiments and that many variations are possible for persons skilled in the art without departing from the scope of the invention.

We claim:

1. A fiber-reinforced metal composite consisting essentially of continuous reinforcing fibers disposed in an aluminum alloy matrix containing about 7 wt% to about 10 wt% of nickel.

2. A fiber-reinforced metal composite according to claim 1, wherein said continuous fibers are inorganic fibers.

3. A fiber-reinforced metal composite according to claim 2, wherein said inorganic fibers are fibers selected from the group consisting of Si—Ti—C—O fibers, SiC fibers, alumina fibers, $Al_2O_3$—$SiO_2$ fibers, boron fibers, $B_4C$ fibers, and carbon fibers.

4. A fiber-reinforced metal composite according to claim 1, wherein said continuous fibers are metal fibers.

5. A fiber-reinforced metal composite according to claim 4, wherein said metal fibers are fibers selected from the group consisting of stainless steel fibers, piano wire fibers, titanium fibers, molybdenum fibers, and nickel fibers.

6. A fiber-reinforced metal composite material comprised of continuous fibers disposed in a metal matrix, said metal matrix consisting essentially of an Al—Ni alloy containing about 7 wt% to about 10 wt% Ni, said metal matrix having fine $Al_3Ni$ crystals uniformly dispersed therein such that the flexural strength of said composite material is greater than the flexural strength of a composite material having said continuous fibers disposed in a pure aluminum metal matrix or an Al—Ni alloy metal matrix containing 6 wt% Ni or less.

7. The fiber-reinforced metal composite material of claim 6, wherein said continuous fibers are selected from the group consisting of Si—Ti—C—O fibers, SiC fibers, alumina fibers, $Al_2O_3$—$SiO_2$ fibers, boron fibers, $B_4C$ fibers, and carbon fibers.

8. The fiber-reinforced metal composite material of claim 6, wherein said continuous fibers are selected from the group consisting of stainless steel fibers, piano wire fibers, titanium fibers, molybdenum fibers, and nickel fibers.

9. The fiber-reinforced metal composite material of claim 7, wherein said metal matrix consists essentially of an Al—Ni alloy containing about 8 wt% Ni.

10. The fiber-reinforced metal composite material of claim 8, wherein said metal matrix consists essentially of an Al—Ni alloy containing about 8 wt% Ni.

* * * * *